US010016078B1

(12) United States Patent
McDermott et al.

(10) Patent No.: US 10,016,078 B1
(45) Date of Patent: Jul. 10, 2018

(54) BEDSHEET

(71) Applicants: Robert D. McDermott, Sandy, UT (US); Scott D. McDermott, Cottonwood Heights, UT (US)

(72) Inventors: Robert D. McDermott, Sandy, UT (US); Scott D. McDermott, Cottonwood Heights, UT (US)

( * ) Notice: Subject to any disclaimer, the term of this patent is extended or adjusted under 35 U.S.C. 154(b) by 302 days.

(21) Appl. No.: 14/861,882

(22) Filed: Sep. 22, 2015

Related U.S. Application Data

(60) Provisional application No. 62/053,541, filed on Sep. 22, 2014.

(51) Int. Cl.
*A47G 9/02* (2006.01)
*A47G 9/04* (2006.01)
*A47C 21/00* (2006.01)

(52) U.S. Cl.
CPC ..... *A47G 9/0238* (2013.01); *A47C 21/00* (2013.01); *A47G 9/02* (2013.01); *A47G 9/04* (2013.01)

(58) Field of Classification Search
CPC .. A47G 9/0238; A47G 9/0246; A47G 9/0261; A47C 31/105
See application file for complete search history.

(56) References Cited

U.S. PATENT DOCUMENTS 2,679,056 A * 5/1954 Simpson ..... A47G 9/0246 5/485
3,654,646 A * 4/1972 McMahon, Jr. ..... A47C 21/024 5/482
3,855,655 A * 12/1974 Propst ..... A47C 21/00 5/488
4,488,323 A * 12/1984 Colburn ..... A47C 21/022 5/496
4,596,618 A * 6/1986 Hammond ..... A47G 9/0246 156/164
4,672,702 A * 6/1987 Isham ..... A47G 9/02 5/497
5,638,562 A * 6/1997 Masoncup ..... A47G 9/0246 5/482
5,884,349 A * 3/1999 Gretsinger ..... A47C 21/022 5/494
5,946,751 A * 9/1999 DeMay ..... A47G 9/0238 24/72.5
6,044,503 A * 4/2000 McClendon ..... A47G 9/02 5/482
6,061,851 A * 5/2000 Crowell ..... A47G 9/02 5/482
6,108,836 A * 8/2000 Keene, III ..... A47G 9/02 5/482
6,532,608 B2 * 3/2003 Schreiner ..... A47G 9/0246 5/485
7,140,053 B1 * 11/2006 Mangano ..... A47G 9/02 5/482
2010/0058537 A1 * 3/2010 Schuck ..... A47G 9/02 5/493
2012/0317723 A1 * 12/2012 Liversage ..... A47G 9/0246 5/497
2014/0101850 A1 * 4/2014 Cuneo ..... A47G 9/02 5/497

* cited by examiner

*Primary Examiner* — Robert G Santos
*Assistant Examiner* — Rahib T Zaman
(74) *Attorney, Agent, or Firm* — Amy Fiene; James Sonntag

(57) ABSTRACT

A bedsheet with a bottom sheet attached to a top sheet by a foot panel and elastic panel combination.

13 Claims, 2 Drawing Sheets

BEDSHEET

CROSS REFERENCE TO RELATED APPLICATIONS

Priority is claimed from U.S. Provisional Patent Application 62/053,541, filed 22 Sep. 2014, which is hereby incorporated by reference.

BACKGROUND

Secured bedsheets come in various forms. For example, a top sheet may be secured to a bottom sheet by stitching, buttons, zippers, straps, hook and loop fasteners, etc. These securement methods are deficient because the top sheet applies pressure on the person's feet and does not allow movement of the top sheet from the foot or base of the top sheet to relieve the pressure. Further, when the person in the bed rolls over, wiggles his or her feet or otherwise adjusts his or her body, there is no flexibility to absorb stresses on the bedsheets. As a result of this lack of accommodation for movement of the bedsheets, the top sheet and the bottom sheet can both be pulled out from the crevice between the upper and lower mattresses at the foot of the bed, thereby defeating the purpose of providing the combined top and bottom sheet.

Another possible result of this lack of accommodation for movement of the bedsheets is that the top sheet can be pulled down to an unacceptable position, uncovering the upper part of the user's body. Also, the stresses applied to the stitching at the foot of the bed where the top sheet is joined to the bottom sheet may serve to rip or pull out the stitching.

The problem is only compounded when the bedsheet combination is put on a bed that has a tricky bedframe. For example, a bunkbed style frame is already difficult to fit sheets given its elevated state. Also, side boards can make tucking sheets under the mattress an arduous task. These side boards also find use in trundle beds and waterbeds, and increase the difficulty in making a bed and keeping sheets in place once made.

What is sought after is a bedsheet that improves on standard sheets and sheet combinations for making a bed and then keeping the sheets in place.

SUMMARY

A bedsheet that for making a bed may comprise a top sheet, a bottom sheet, with a foot panel, and a stretch panel connected to an end of the top sheet and an end of the bottom sheet.

DETAILED DESCRIPTION

Figure 1:
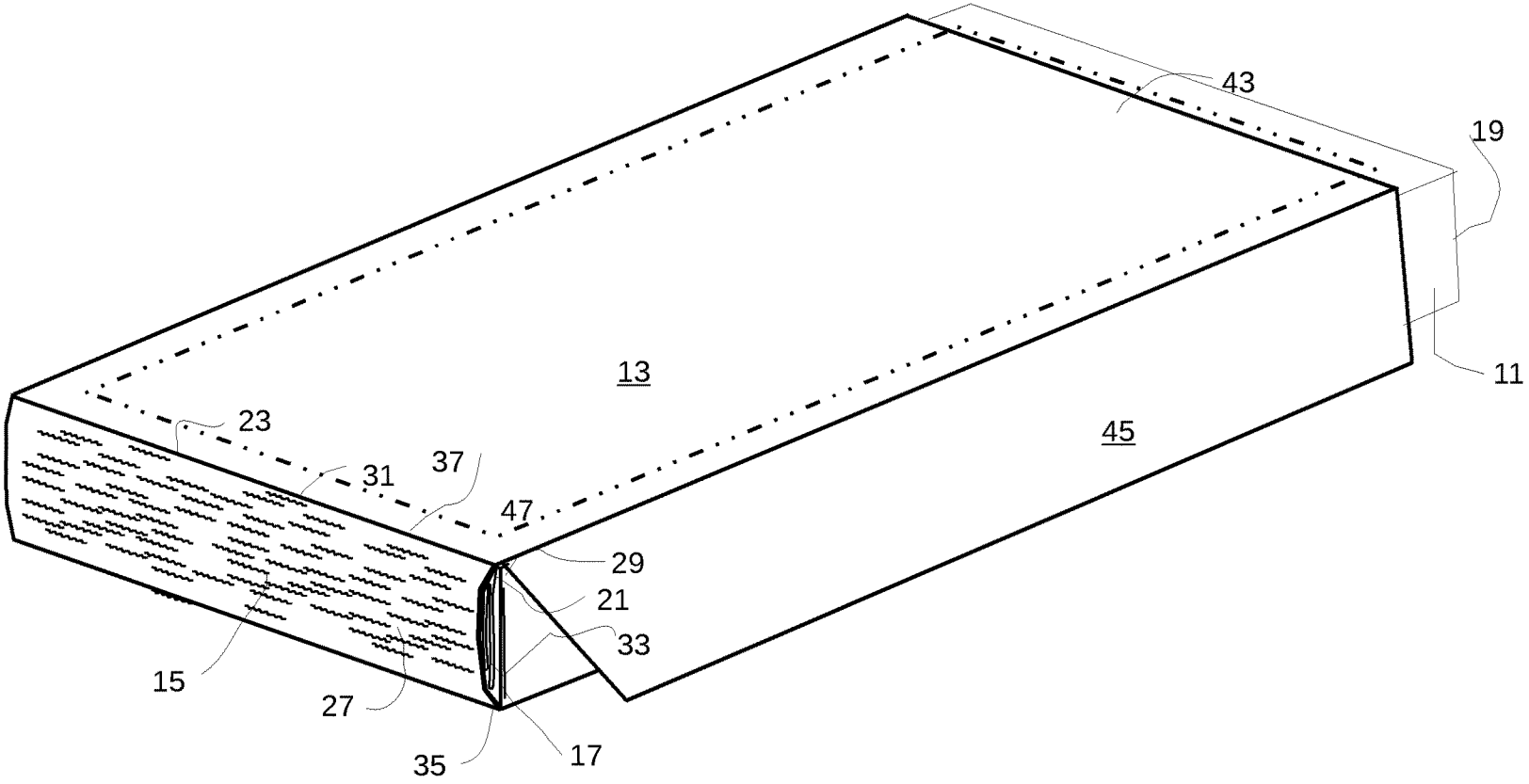
FIG. 1 shows a perspective view of a bedsheet on a mattress.
Figure 2:
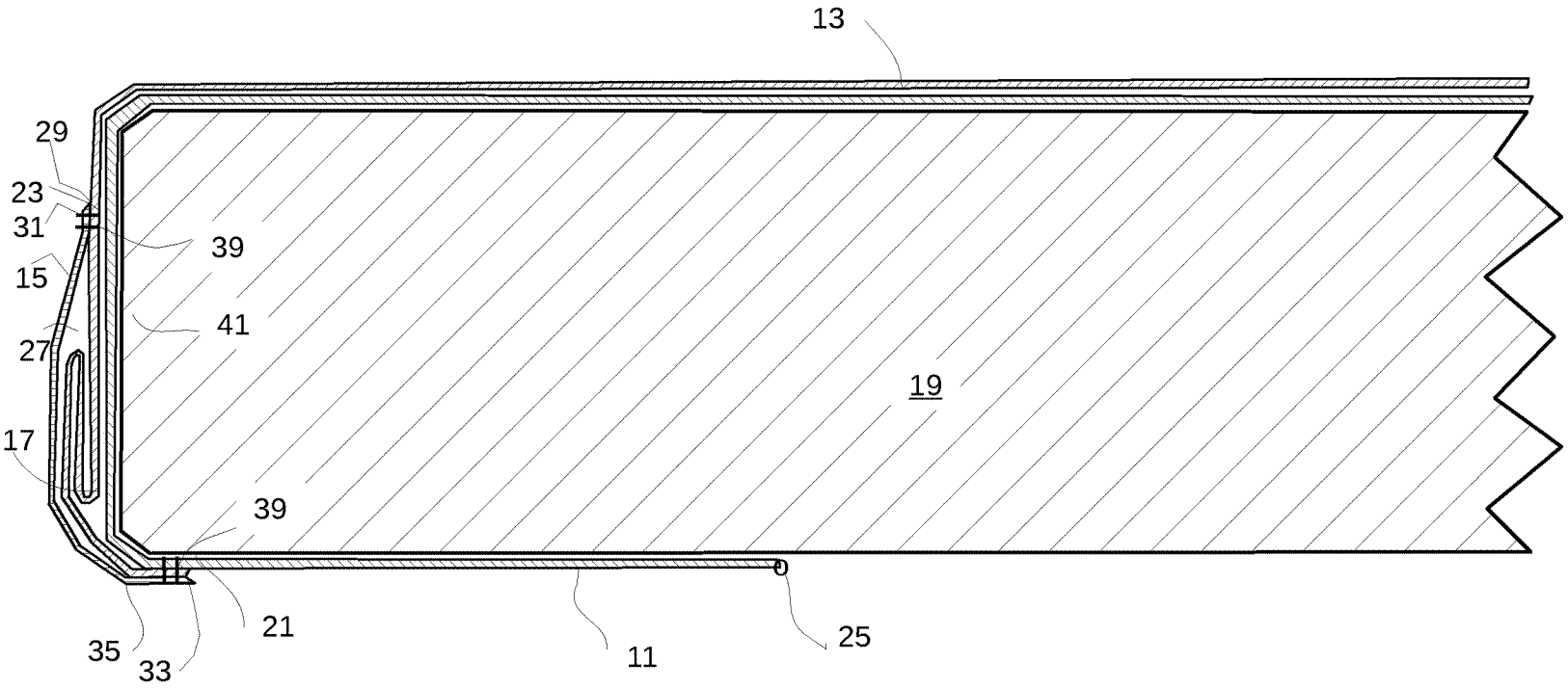
FIG. 2 is a side cross-sectional view of another bedsheet on a mattress.

Referring to FIG. 1 and FIG. 2, embodiments comprise a bottom sheet or panel 11, a top sheet or panel 13, joined by a stretch panel 15, and a foot panel 17. The bottom sheet 11 is constructed so that it can be fitted to a mattress 19 by any suitable system. For example, the bottom sheet 11 can be a formed fitted or contoured sheet that is held in place over the mattress 19 by means of an elastic strip 25 (FIG. 2).

The top sheet 13 overlies at least a portion of the bottom sheet 11, such that the bottom sheet 11 and top sheet 13 each have a foot portion 21, 23 near each other at a foot end of the mattress. Foot portions 21, 23 are generally disposed along a line across the sheet near the foot of each sheet, and are where attachment is made. The foot portions 21, 23 of the bottom and top sheets are attached to each other by a combination 27 of the foot panel 17 and the stretch panel 15 between the foot portions 21, 23. The foot panel 17 and the stretch panel 15 are joined at their respective top edges 29, 31 and also at their respective bottom edges 33, 35. The attached top 29, 31 and bottom 33, 35 are attached to the foot portions 21, 23 of the bottom and top sheets 11, 13, connecting the bottom and top sheets together.

The foot panel 17 lies under the stretch panel 15 adjacent to the bottom sheet 11. When installed on a bed mattress, the stretch panel 15 appears as a continuation of the top sheet 13 that extends from its foot portion 23. The foot portion of the top sheet 23, which is the joinder to the top edge 31 and beginning of the stretch panel, may be at the lateral edge of the mattress or on top of the mattress, or where the stretch and foot panels 15, 17 can suitably function. In FIG. 1, the foot portion 23 of the top sheet 13 is at the corner of the lateral edge and top of the mattress 37. In FIG. 2 showing a cross-sectional view at the foot end of a mattress, the foot portion 23 of the top sheet is at the lateral edge 41 of the mattress 19.

The foot panel 17 is covered by the stretch panel 15 when the bed sheet is installed and functions to provide space for feet between the top and bottom sheets 11, 13, and is sized to allow feet and foot movement. The stretch panel 15 functions to help maintain the top sheet 13 in position relative to the bottom sheet, and present a smooth surface at the bottom edge of the mattress so that the bottom sheet can be attached or tucked under the mattress without interference. The foot panel 17 is dimensioned longer than the stretch panel so that when the stretch panel 15 is unstretched, the foot panel 17 is folded under the stretch panel between the bottom and top sheets 11, 13. This would be the condition for an unoccupied bed, or where little room for feet is required. If feet are moved or positioned to require more space, the stretch panel 15 stretches or extends and the foot panel 17 partially or fully unfolds to provide the space necessary without pulling the bottom sheet free from under the mattress.

The bottom sheet 11, top sheet 13, and the foot panel 17, can be of the same or different material, and be any material suitably used in bedsheet construction. The stretch panel 15 is of a compatible material that is elastic, or stretches. The stretch panel may be of a single fabric or be of a composite material, and may optionally incorporate structures, such as holes, slits, or pleats to facilitate the stretch. A suitable stretch fabric is an elastic fabric such as spandex, or like fabric.

The panels may be attached to one another as described by any suitable method, such as, for example, sewing or adhesing. The top sheet 13 and the foot panel 17 may be of the same sheet of fabric, where the foot panel may be an extension of the fabric of the top sheet without any seams or additional attachment between them. In FIG. 2 is shown such a top sheet 13/foot panel 17, with attachments to the bottom sheet 11 and stretch panel 15 by sewn stiches 39.

Optionally, the bottom sheet may incorporate an integrated sewn-in mattress pad 43. Such a mattress pad is advantageous because it provides one less thing to tuck under the mattress and thus one more feature for quick and easy making of the bed.

Optionally, the top sheet may include side extensions 45 or have cut-out rectangular sections at the corners 47 allow for a better appearing or mitered corners. Rather than having to tuck in bunched up corner pieces of the sheet at the corners of the mattress, pre-shaped top-sheet corners allow the material to drape nicely at the sides of the mattress and be easily tucked under the mattress if desired.

With one or more recited features discussed herein, a one-stop shop bedsheet can make making the bed an easy task.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention

What is claimed is:

1. A bedsheet comprising:

a top sheet;

a bottom sheet;

a foot panel; and a stretch panel, the bottom sheet configured to overlie a mattress, the mattress having a foot end, the top sheet overlying at least a portion of the bottom sheet, a foot portion of the bottom sheet and a foot portion of the top sheet disposed at the foot end of the mattress, the foot portion of the bottom sheet and the foot portion of the top sheet attached together by a combination of the foot panel and the stretch panel between the foot portions, a top edge of the foot panel attached to a top edge of the stretch panel and a bottom edge of the foot panel attached to a bottom edge of the stretch panel, the attached bottom edges of the foot panel and the stretch panel further attached to the foot portion of the bottom sheet, the foot panel underlying the stretch panel between the top and bottom sheets, the foot panel being dimensioned longer than the stretch panel, wherein the foot panel is an extension of a fabric of the top sheet without any seams or additional attachment between them; the stretch panel having first and second terminal ends; the first terminal end of the stretch panel directly connected only to the top sheet where the extension of the fabric of the top sheet begins to form the foot panel; the second terminal end of the stretch panel directly connected to a terminal end of the foot panel and a portion of the bottom sheet, such that the entirety of the foot panel is located between the terminal ends of the stretch panel with the stretch panel being located relatively outward of the foot panel and the bottom sheet being located relatively inward of the foot panel.

2. A bedsheet as in claim 1 wherein the bottom sheet includes a mattress pad.

3. A bedsheet as in claim 1 wherein lateral edges of the top sheet overhang edges of the mattress and are cut to provide a mitered corner.

4. A bedsheet comprising:

a top sheet;

a bottom sheet;

a foot panel; and a stretch panel, the bottom sheet configured to overlie a mattress, the mattress having a foot end, the top sheet overlying at least a portion of the bottom sheet, a foot portion of the bottom sheet and a foot portion of the top sheet disposed at the foot end of the mattress, the foot portion of the bottom sheet and the foot portion of the top sheet attached together by a combination of the foot panel and the stretch panel between the foot portions, a top edge of the foot panel attached to a top edge of the stretch panel and a bottom edge of the foot panel attached to a bottom edge of the stretch panel, the attached bottom edges of the foot panel and the stretch panel further attached to the foot portion of the bottom sheet, the foot panel underlying the stretch panel between the top and bottom sheets, the top sheet having extended lateral edges to overhang an edge of the mattress, the bottom sheet including a mattress pad overlying the mattress, the mattress pad being integrated with the mattress, wherein the foot panel is an extension of a fabric of the top sheet without any seams or additional attachment between them; the stretch panel having first and second terminal ends; the first terminal end of the stretch panel directly connected only to the top sheet where the extension of the fabric of the top sheet begins to form the foot panel; the second terminal end of the stretch panel directly connected to a terminal end of the foot panel and a portion of the bottom sheet, such that the entirety of the foot panel is located between the terminal ends of the stretch panel with the stretch panel being located relatively outward of the foot panel and the bottom sheet being located relatively inward of the foot panel.

5. The bedsheet of claim 1, wherein the foot panel is dimensioned such that it can be folded under the stretch panel between the bottom and top sheets when the stretch panel is unstretched.

6. The bedsheet of claim 1, wherein the stretch panel comprises holes, slits, or pleats to facilitate a stretch.

7. The bedsheet of claim 1, wherein the foot panel is dimensioned to provide space for feet between the top and bottom sheets and thereby allow feet and foot movement.

8. The bedsheet of claim 1, wherein the foot panel is configured to partially or fully unfold to provide space necessary without pulling the bottom sheet free from under the mattress.

9. The bedsheet of claim 1, wherein the foot panel is of a different material than the bottom sheet and top sheet.

10. The bedsheet of claim 1, wherein the stretch panel is made of a single fabric.

11. The bedsheet of claim 1, wherein the stretch panel is made of a composite material.

12. The bedsheet of claim 1, further comprising pre-shaped side extensions at corners of the top sheet that allow the material to drape at sides of the mattress and be easily tucked under the mattress if desired.

13. The bedsheet of claim 4, wherein the mattress pad is integrated by being sewn-in.

* * * * *